US010502403B2

(12) United States Patent
Csirmaz et al.

(10) Patent No.: US 10,502,403 B2
(45) Date of Patent: Dec. 10, 2019

(54) INTEGRATED CARDAN MECHANISM FOR ADJUSTABLE LUMINAIRES

(71) Applicant: GE Lighting Solutions, LLC, East Cleveland, OH (US)

(72) Inventors: Rita Csirmaz, Budapest (HU); Tamás Vásárhelyi, Budapest (HU)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 199 days.

(21) Appl. No.: 15/382,822

(22) Filed: Dec. 19, 2016

(65) Prior Publication Data

US 2017/0299162 A1 Oct. 19, 2017

Related U.S. Application Data

(60) Provisional application No. 62/322,824, filed on Apr. 15, 2016.

(51) Int. Cl.
*F21V 17/00* (2006.01)
*F21V 21/29* (2006.01)
(Continued)

(52) U.S. Cl.
CPC ..... *F21V 21/29* (2013.01); *F21V 14/02* (2013.01); *F21V 17/12* (2013.01); *F21V 19/02* (2013.01); *F21Y 2115/10* (2016.08)

(58) Field of Classification Search
CPC ..... F21V 21/29; F21V 14/02; F21V 17/12; F21V 19/02; F21V 21/30; F21Y 2115/10
See application file for complete search history.

(56) References Cited

U.S. PATENT DOCUMENTS 6,511,208 B1 1/2003 Kotovsky
6,719,438 B2 4/2004 Sevack et al.
(Continued)

FOREIGN PATENT DOCUMENTS

DE 20 2013 102148 U1 3/2014
EP 0 622 257 A2 11/1994
(Continued)

OTHER PUBLICATIONS

Extended European Search Report and Written Opinion issued in connection with corresponding EP Application No. 17164841.3 dated May 29, 2017.
(Continued)

*Primary Examiner* — Y M. Lee
(74) *Attorney, Agent, or Firm* — Buckley, Maschoff & Talwalkar, LLC

(57) ABSTRACT

An integrated cardan mechanism for an adjustable luminaire for a lighting system. In an embodiment, a ring component includes a generally circular ring, a first inward connector having a through hole and extending inwardly from the ring component along a first axis, a second inward connector portion having a through hole and extending inwardly from the circular ring component along the first axis opposite the first inward connector, a first outward connector comprising a through hole and a first tab and extending outwardly from the ring component along a second axis, and a second outward connector comprising a second through hole and a second tab and extending outwardly from the circular ring component along the second axis opposite the first outward connector.

20 Claims, 7 Drawing Sheets

(51) Int. Cl.

| | |
|---|---|
| ***F21V 14/02*** | (2006.01) |
| ***F21V 17/12*** | (2006.01) |
| ***F21V 19/02*** | (2006.01) |
| *F21Y 115/10* | (2016.01) |

(56) References Cited

U.S. PATENT DOCUMENTS

| | | | | |
|---|---|---|---|---|
| 2005/0200751 | A1 | 9/2005 | Weaver | |
| 2006/0065801 | A1* | 3/2006 | Anderson, II | F16L 3/16 248/311.2 |
| 2012/0147604 | A1 | 6/2012 | Farmer | |
| 2015/0276190 | A1 | 10/2015 | Devlin | |

FOREIGN PATENT DOCUMENTS

| | | | |
|---|---|---|---|
| FR | 2 738 404 | A1 | 3/1997 |
| GB | 2469344 | A | 10/2010 |
| WO | 2013/014888 | A1 | 1/2013 |
| WO | 2014/090744 | A1 | 6/2014 |

OTHER PUBLICATIONS

"AR111 Square Gimbal Housing Kit," Glacial Tech Inc, Retrieved from the Internet URL: http://www.glaciallight.com/products/ar111-kit-Square.htm, pp. 1-4 (Jan. 20, 2017).

"Gimbal fitting G8.5 35W/70W recessed lighting fixture," Retrieved from the Internet URL: http://www.home-supplies.com/Gimbal-fitting-G8-5-35W-70W-recessed-lighting-fixture-11308069/, pp. 1-17 (Jan. 23, 2017).

"MH PAR20 Double Gimbal New Construction—MGMH2O-4E," Brodwax Lighting Corporation, Retrieved from the Internet URL: http://www.brodwax.com/mh-par20-double-gimbal-new-construction-mgmh20-4e.html, pp. 1-2 (Jan. 20, 2017).

"Triple Midi Trimless," Lucent Lighting, Retrieved from the Internet URL: http://www.lucent-lighting.com/products/prospex-light-fixtures/gimbals/gimbal-midi/triple-midi-trimless/, pp. 1-2 (Jan. 4, 2017).

* cited by examiner

INTEGRATED CARDAN MECHANISM FOR ADJUSTABLE LUMINAIRES

TECHNICAL FIELD

The invention generally relates to lighting systems, and more particularly to a novel integrated cardan mechanism for adjustable luminaires.

BACKGROUND OF THE INVENTION

In many lighting system situations, it is desirable to illuminate an area or item to bring attention to that area or item, and/or to create a lighting effect. Thus, adjustable lamps or lighting fixtures or luminaires have been designed that can be manipulated and/or controlled and/or adjusted to provide and/or direct light emitted from one or more light sources (such as one or more light-emitting diodes (LEDs)) to illuminate a specific area or item. In some cases, the adjustable lamp or luminaire includes one or more light sources mounted to a gimbal assembly that typically includes two rings that can be moved and/or positioned to adjust the angle of the light source(s) to achieve the desired lighting results. The gimbal assembly may then be left alone until a need arises to re-direct the light source to illuminate another area and/or item and the like.

Some conventional gimbal assemblies are complex and difficult to manufacture, which can add costs to the adjustable luminaire and/or light fixture. Thus, it would be desirable to provide an adjustable luminaire assembly that is simple to manufacture and/or assemble so that adjustable luminaires can be fabricated that are less costly than conventional adjustable luminaires.

SUMMARY OF THE INVENTION

Presented is an integrated cardan mechanism for an adjustable luminaire. In an embodiment, a ring component includes a generally circular ring, a first inward connector having a through hole and extending inwardly from the ring component along a first axis, and a second inward connector portion having a through hole and extending inwardly from the circular ring component along the first axis opposite the first inward connector. The ring component also includes a first outward connector comprising a through hole and a first tab and extending outwardly from the ring component along a second axis, and a second outward connector comprising a second through hole and a second tab and extending outwardly from the circular ring component along the second axis opposite the first outward connector.

In another embodiment, a rotatable luminaire is presented. The rotatable luminaire includes a luminaire housing, a cardan mechanism rotatably connected to the luminaire housing, and a light source housing rotatably connected to the cardan mechanism. The cardan mechanism includes a generally circular ring having a first inward connector with a through hole and extending inwardly a predetermined distance from the ring component along a first axis, a second inward connector portion having a through hole and extending inwardly a predetermined distance from the circular ring component along the first axis opposite the first inward connector, a first outward connector comprising a through hole and a first tab and extending outwardly a predetermined distance from the ring component along a second axis, and a second outward connector comprising a second through hole and a second tab and extending outwardly a predetermined distance from the circular ring component along the second axis opposite the first outward connector.

BRIEF DESCRIPTION OF THE DRAWINGS

Features and advantages of some embodiments, and the manner in which the same are accomplished, will become more readily apparent with reference to the following detailed description taken in conjunction with the accompanying drawings, which illustrate exemplary embodiments (not necessarily drawn to scale), wherein.

DETAILED DESCRIPTION

An integrated cardan mechanism is presented herein which holds and/or supports one or more light sources to form an adjustable luminaire. Some configurations may include one or more luminaire heads (for example, single, double, triple and more configurations) that can be rotated and/or tilted about two axes of movement to direct light from one or more light sources in a desired direction to provide a desired illumination feature.

According to some embodiments, a cardan mechanism may include a ring component as described herein. The ring component in accordance with this disclosure may be configured to provide and/or perform multiple functions or operations. For example, in some embodiments, the ring component functions to affix a luminaire head to a lighting fixture housing and/or to a housing wall; to keep or hold a luminaire head in the correct and/or desired position without needing any additional spacers; to allow tilting of the luminaire head along two axis of rotation (while also permitting the luminaire head to be finally adjusted to maintain a desired position); and to limit the rotation angles so that the luminaire head cannot conflict with a housing wall; and when two or more luminaire heads are included within a lighting fixture, to limit the rotations angles such that the two or more luminaire heads cannot conflict or interfere with each other and/or with a housing wall.

In accordance with some embodiments, the ring component includes features which perform spacer functions that enable the luminaire head to be aimed or guided by a user in a desired direction and then held or retained in that position without any additional spacers. These features can provide simplicity of assembly for such a structure. Accordingly, a luminaire head can be adjustably attached and/or affixed to the ring component along a first rotation axis, and then the integrated ring assembly (which includes the ring component and the luminaire head) can be adjustably attached and/or affixed to a luminaire housing or to walls of a lighting fixture along a second axis of rotation.

FIGS. 1-7 illustrate embodiments of exemplary ring components and/or integrated ring assemblies and their component parts, and illustrate their design and/or performance advantages. Identical or similar parts and/or elements and/or components in the various drawings are designated using the same reference numbers.

Figure 1:
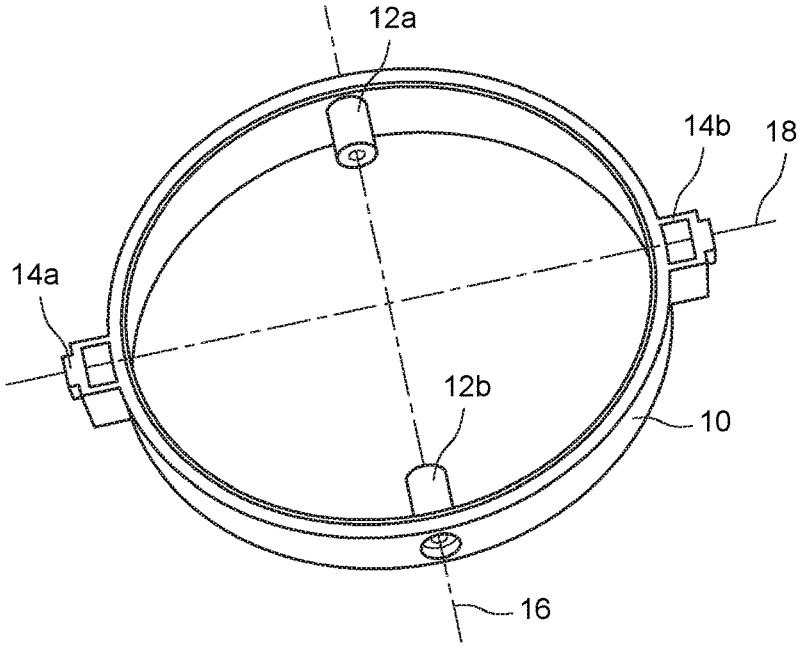
FIG.1 is a perspective view of a ring component according to some embodiments of the invention.

FIG.1 is an exemplary three-dimensional or perspective view of a ring component 10 in accordance with some embodiments. The ring component 10 includes a generally circular ring element having a first inward connector 12*a* and a second inward connector 12*b* that each extend in an inward direction from the ring element of the ring component 10 to form a first axis of rotation 16 therebetween (across a center line of the ring component 10). The first and second inward connectors 12*a* and 12*b* can hold, without any additional spacers, a luminaire head (not shown in FIG. 1) therebetween (inside of the ring component 10) in a manner that allows the luminaire head to rotate about the first axis 16. A first outward connector portion 14*a* and a second outward connector portion 14*b* extend outwardly from the ring component 10 along a second axis 18, which second axis may be in a plane of and crossing a center point of the ring component 10. In some embodiments, the first and second outward connector portions 14*a* and 14*b* are configured for adjustable attachment (without any additional spacers) to a housing of a luminaire, such that an integrated ring assembly (which includes the ring component 10 and a luminaire head, not shown) can be positioned or adjusted. Thus, in some implementations, an integrated ring assembly may thus be attached to a housing wall in a manner allowing the integrated ring assembly to be rotated about the second axis 18. It should be understood that, in some embodiments, the first axis 16 and the second axis 18 are perpendicular to each other, whereas in other embodiments the first axis is not perpendicular to the second axis.

In some embodiments, the ring component 10 may be made of a lightweight material having adequate tensile strength to support a light source and/or light source housing. For example, the ring component 10 may be fabricated of a lightweight metal, such as aluminum. The ring component 10 could also be fabricated of other lightweight materials, such as a polymer material, a plastics material, or a composite material.

Referring again to FIG. 1, in accordance with some embodiments, the first axis 16 and/or the second axis 18 may be in the same plane of the ring component 10, and in some implementations crosses the center point of the ring component 10 (as shown). However, in some implementations, the first axis 16 and the second axis 18 are in the same plane but do not cross the center point of the plane of the ring component 10. In other embodiments, the first and second axes 16 and 18 are not in the same plane (i.e., they are in different planes), and the first axis 16 and the second axis 18 may or may not cross in a center point or portion of the ring component 10.

Figure 2:
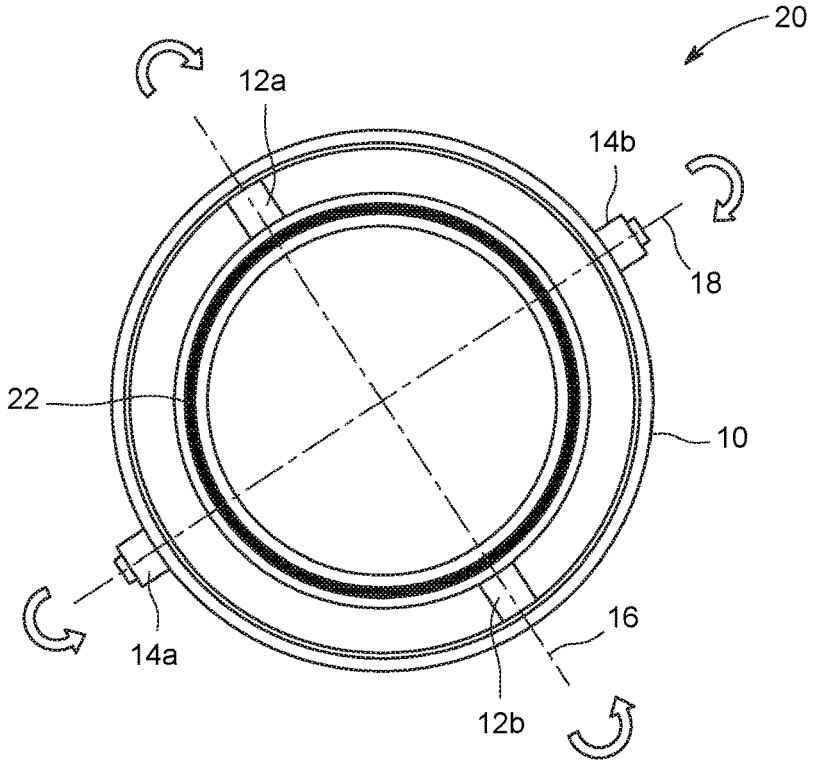
FIG. 2 is a bottom view of the ring component shown in FIG. 1 with an adjustably attached luminaire head to form an integrated ring assembly in accordance with some embodiments of the invention.

FIG. 2 is a bottom view of the ring component 10 shown in FIG. 1 with a luminaire head 22 attached thereto to form an integrated ring assembly 20. For ease of understanding, a light source (such as one or more light-emitting diodes (LEDs) or a compact fluorescent (CFL) bulb or any other type of light source) is not shown but would be housed within the luminaire head 22. Also shown in FIG. 2 are the first axis 16 and second axis 18 along with arrows indicating how the luminaire head 22 may be rotated.

Figure 3:
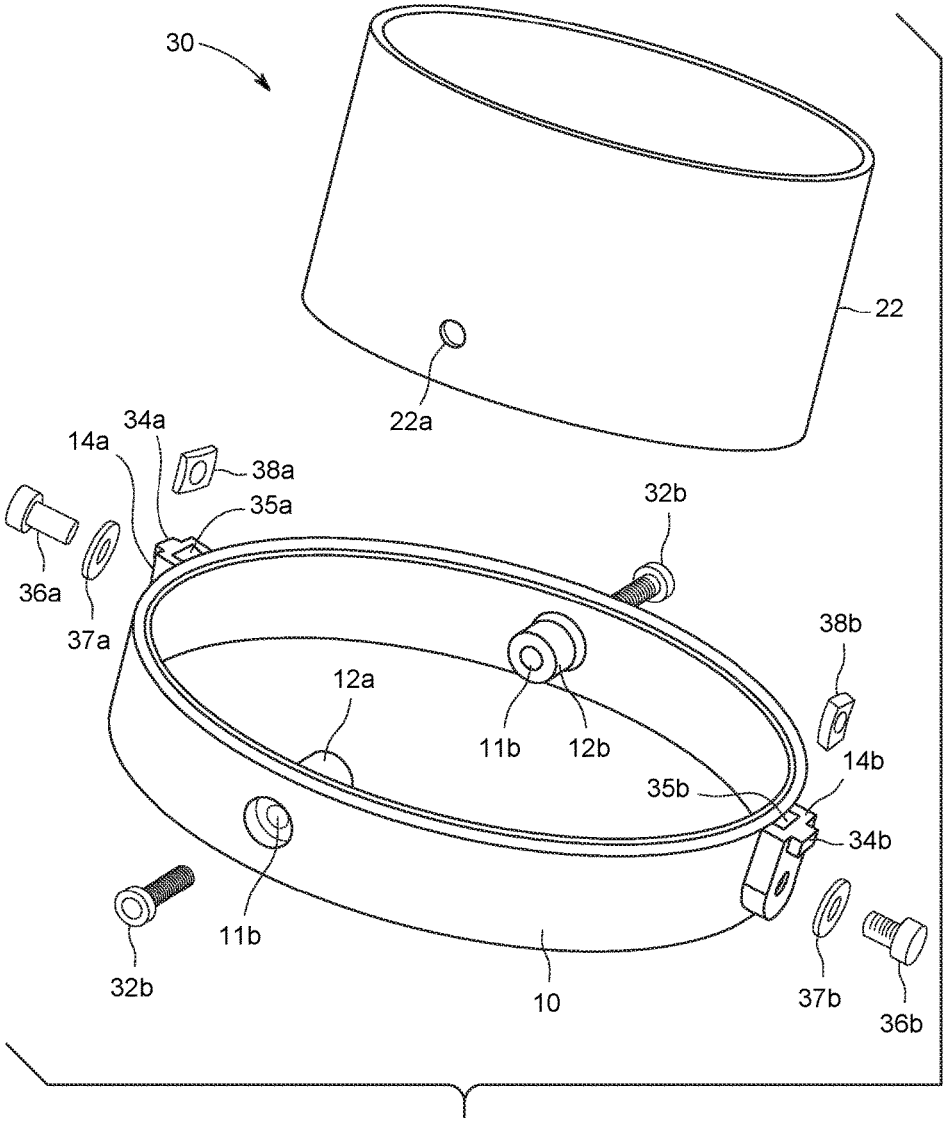
FIG. 3 is a perspective exploded view of a ring component and luminaire head in accordance with some embodiments of the invention.

FIG. 3 is an exploded perspective view 30 of a ring component 10, a luminaire head 22 and additional parts or accessories needed to assemble an integrated ring assembly for an adjustable luminaire in accordance with some embodiments. During assembly, a first screw 32*a* and a second screw 32*b* can be inserted through passageways or holes 11*b* of the first and second inward connectors 12*a* and 12*b*, and through the holes 22*a* (only one is shown in FIG. 3) of the luminaire head 22, to form an integrated ring assembly (see 40*a* and 40*b* in FIGS. 4A and 4B). According to some embodiments, the screws 32*a* and 32*b* are conventional threaded screws, but in other implementations different types of fasteners could be used. In some embodiments, the end portions of the two fasteners 32*a* and 32*b* may be smooth, non-threaded or round surfaces which have a good fit or slide-able fit with the corresponding holes 22*a* of the luminaire head 22, thus providing for a smooth rotation of the luminaire head 22 about the axis 16 (see FIG. 2). It is noted that the internal holes 1 lb in the corresponding first and second inward connectors 12*a* and 12*b* may be threaded, whereas the holes 22*a* may be non-threaded. In some implementations, internal holes 11*b* in the first and second inward connectors 12*a* and 12*b* may be non-threaded, whereas the corresponding two holes 22*a* are threaded. Thus, various combinations of threaded and non-threaded holes 11*b* and/or 22*a* may be used along with various different types of fasteners.

Referring again to FIG. 3, in some embodiments the first outward connector portion 14*a* and the second outward connector portion 14*b* (which extend outwardly from the ring component 10, as shown) include cutout portions or first and second receptacles 35*a* and 35*b*, respectively. The first receptacle 35*a* may be configured for accepting or seating a first nut 38*a*, and the second receptacle 35*b* may be configured for accepting or seating a second nut 38*b* therein during assembly. For example, the first and second receptacles 35*a* and 35*b* may have generally square shapes having dimensions to insure a snug fit of the first and second nuts 38*a* and 38*b*. In some implementations, the first nut 35*a* includes inner threads (not shown) which mate with the threads of the first screw 36*a*, whereas the second nut 35*b* includes inner threads for mating with the threads of the second screw 36*b*, during attachment of the integrated ring assembly 20 to a luminaire housing (which will be explained below with regard to FIGS. 5A and 5B). In some embodiments, the first and second outward connectors 14*a* and 14*b* include corresponding tabs 34*a* and 34*b*, respectively, which are restricting features configured to limit the rotation range (or tilting angle) of the integrated ring assembly around the second axis 18 (as explained herein with regard to FIGS. 6A, 6B and 7). Washers 37*a* and 37*b* may be used between the screws (or fasteners) 36*a* and 36*b* and the first and second outward connector portions 14*a*, 14*b* to further enhance rotation. Thus, the first and second nuts 38*a* and 38*b* (which may be characterized as locknuts) can be used to rotatably attach the integrated ring assembly 20 to the luminaire housing and/or housing wall (as shown in FIGS. 4A and 4B and explained herein below).

Figure 4A:
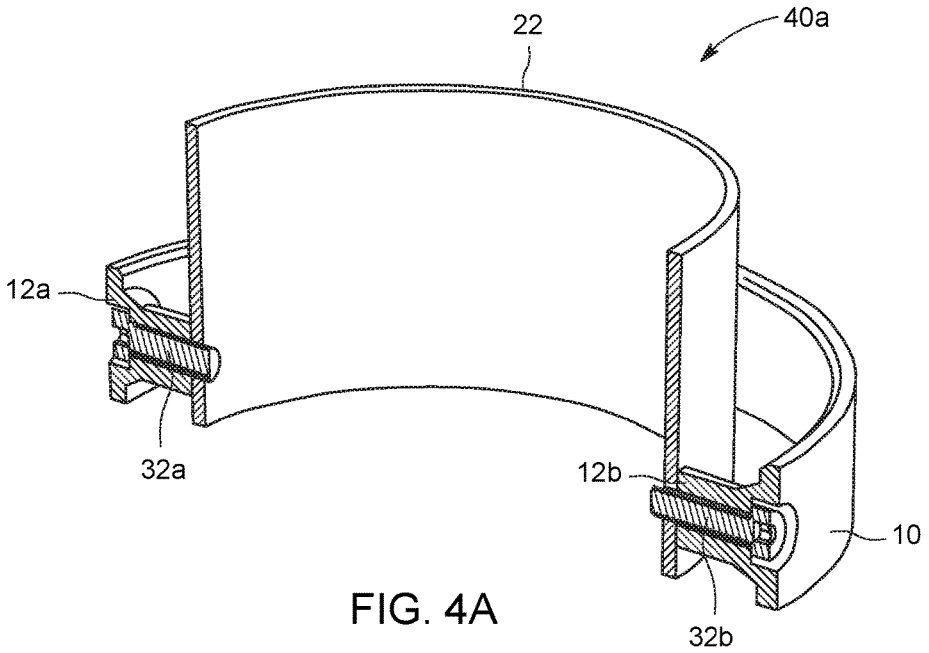
FIG. 4A is a cross-sectional perspective view and FIG. 4B is a cross-sectional front view of an integrated ring assembly including a ring component and luminaire head in accordance with some embodiments of the invention.
Figure 4B:
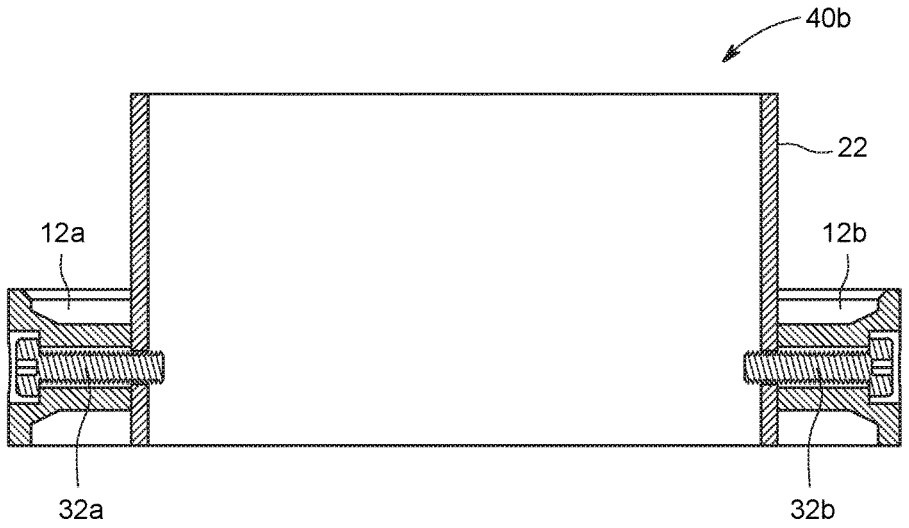

FIGS. 4A and 4B illustrate a cross-sectional perspective view 40*a* and a cross-sectional side view 40*b*, respectively, of an integrated ring assembly 20 which includes the ring component 10 and a luminaire head 22 in accordance with some embodiments. The ring component 10 rotatably couples the luminaire head 22 via screws (or other types of fasteners) 32*a* and 32*b* such that the luminaire head 22 can be rotated and/or tilted about the first axis 16 (see FIG. 2). In some implementations, the rotation of the luminaire head 22 about the first axis 16 is limited by the geometry of the assembled components of the luminaire. In particular, after a predefined tilting angle is reached, an outside wall of the luminaire head 22 will contact an inner surface of the ring component 10 to prevent further tilting (not shown).

Figure 5A:
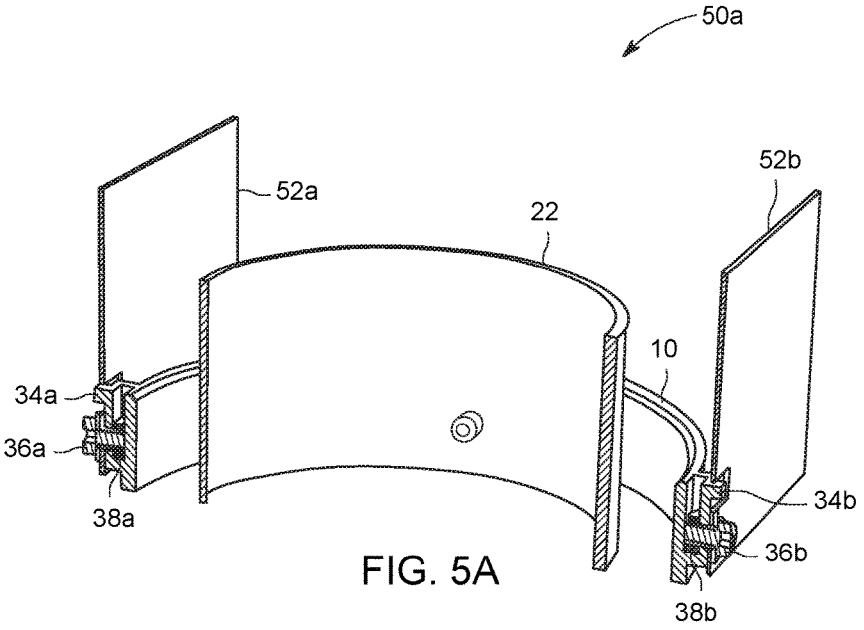
FIGS. 5A is a cross-sectional perspective view.
Figure 5B:
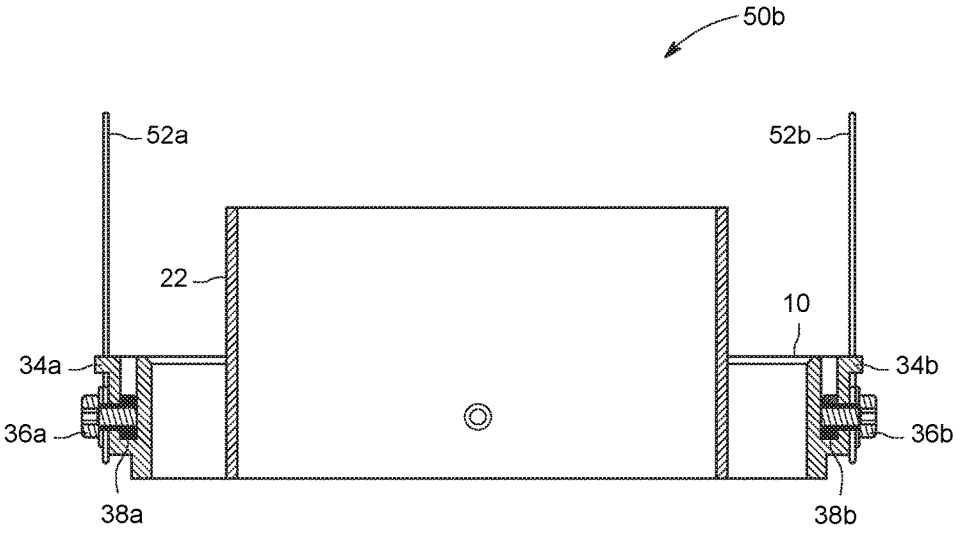
FIG. 5B is a cross-sectional front view, of an integrated ring assembly adjustably affixed to a luminaire housing in accordance with some embodiments of the invention.

FIGS. 5A and 5B show a perspective view 50*a* and a side view 50*b*, respectively, of an integrated ring assembly 20 according to some embodiments. The integrated ring assembly includes the ring component 10 and a luminaire head 22 attached to a first wall portion 52*a* and to second wall portion 52*b* of a luminaire housing. In some embodiments, the screws 36*a* and 36*b* are threaded through corresponding holes in the housing walls 52*a* and 52*b*, and mate with corresponding first and second nuts 38*a* and 38*b* (such as locknuts) which are seated in the corresponding first and second receptacles 35*a* and 35*b* (see FIG. 3). The screws 36*a* and 36*b* can be tightened by a user, in some implementations, from outside the luminaire housing walls 52*a* and 52*b*, and in some embodiments the luminaire head 22 can then be adjusted to a desired angle in order to illuminate an area or object.

Referring again to FIGS. 5A and 5B, in some embodiments, the two outward connectors 14*a* and 14*b* include tabs 34*a* and 34*b*, respectively, which are configured to fit through an opening in the luminaire housing. The tabs 34*a* and 34*b* are restricting features that limit the rotational range of the integrated ring assembly 20 about the second axis 18 (see FIG. 2), as explained further herein with regard to FIGS. 6A, 6B and 7.

Figure 6A:
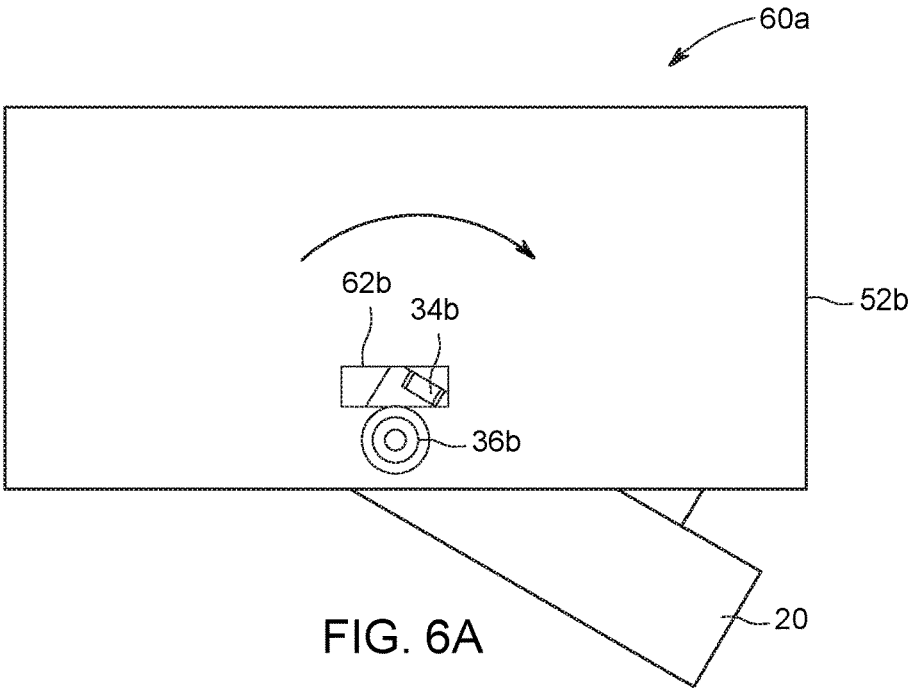
FIGS. 6A and 6B depict outer side views of a rotatable connection of an integrated ring assembly to a luminaire housing in accordance with some embodiments.
Figure 6B:
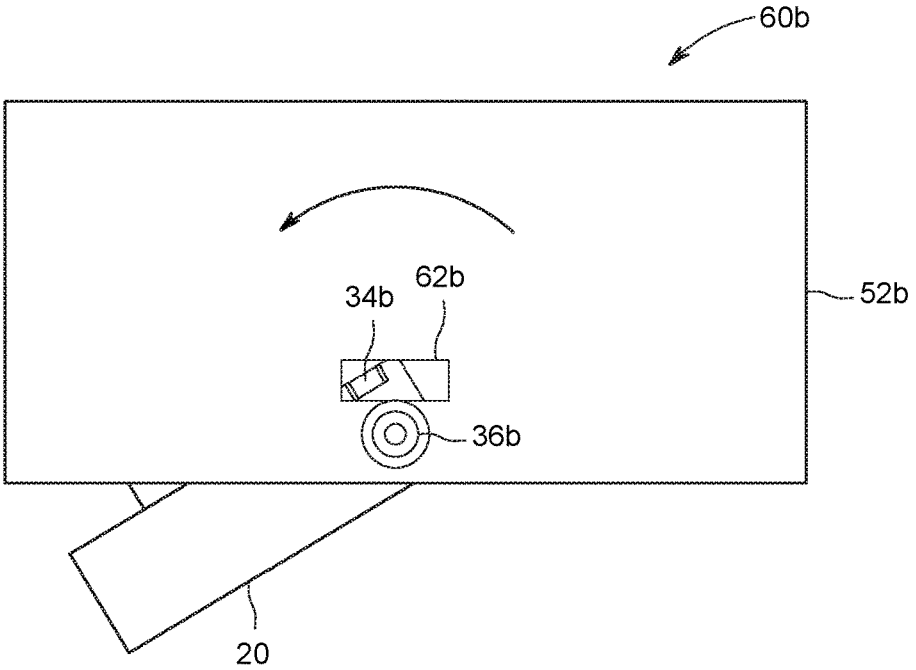

FIGS.6A and 6B depict an outer first side view 60A and an outer second side view 60B, respectively, of the rotatable connection of the integrated ring assembly 20 to the luminaire housing in accordance with some embodiments. FIGS. 6A and 6B show the luminaire head in two extreme positions relative to a rectangular opening 62*b* in a wall 52*b* of a luminaire housing. Thus, a maximum rotational range for tilting of the integrated ring assembly 20 about the second axis 18 (shown in FIGS. 1 and 2) is defined by the range of movement of the tab 34*b* within the opening 62*b*. In particular, FIG. 6A illustrates a first rotational position 60*a* wherein the tab 34*b* contacts an inner portion on the left side of the rectangular opening 62*b* in the housing 52*b*, which therefore restricts the angle at which light can be emitted from a light source (not shown) housed within the luminaire head. In this example, light could then be directed in a generally downward direction and to the left.

Similarly, FIG. 6B illustrates a second rotational position 60*b* wherein an opposite portion of the tab 34*b* is shown contacting an extreme left inner portion of the rectangular opening 62*b* in the housing 52*b*, which therefore restricts the angle at which light can be emitted from the light source (not shown) this different direction. In this example of FIG. 6B, light from a light source within the integrated ring assembly 20 could then be directed in a generally downward direction and to the right.

Accordingly, the rectangular opening 62*b* and tab 34*b* together define the rotational range of the integrated ring assembly 20 (which includes the luminaire head 22 and light source) about the second axis 18 (shown in FIGS. 1 and 2). In some implementations, a second similar tab 34*a* and opening 62*a* (not shown) may be found on an opposite wall portion of the luminaire housing.

Figure 7:
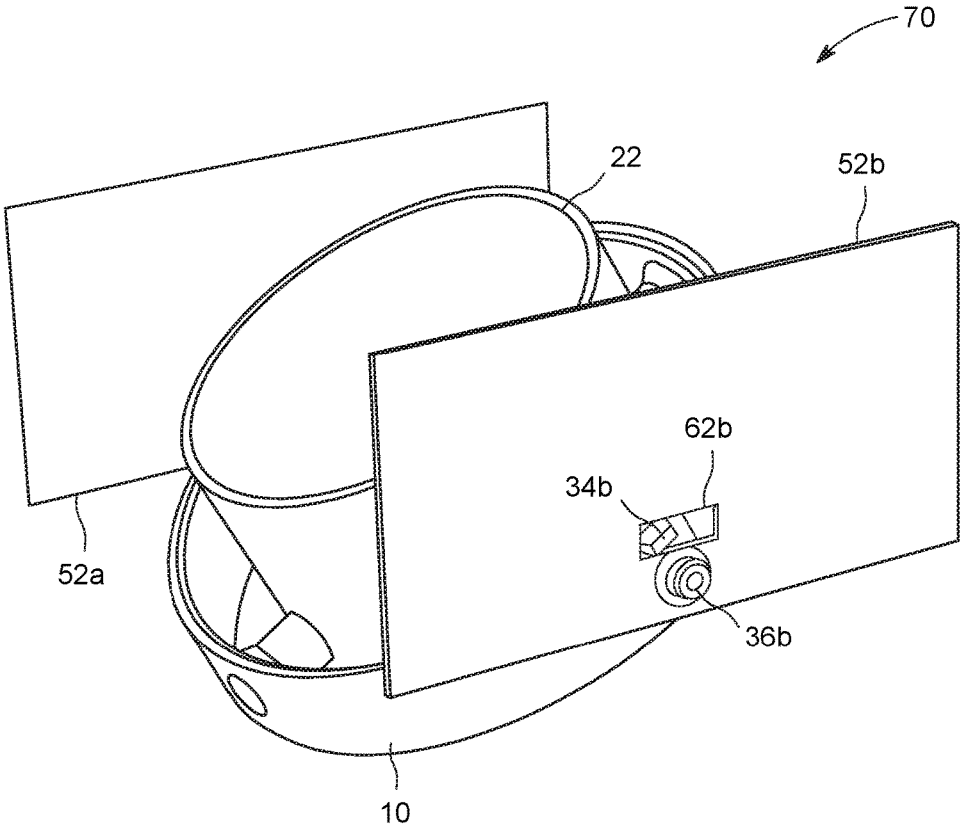
FIG. 7 is a perspective view of the adjustable luminaire of FIGS. 6A and 6B including an integrated ring assembly in accordance with some embodiments of the invention.

FIG. 7 illustrates a perspective view 70 of the luminaire assembly 60*a* and/or 60*b* of FIGS. 6A and 6B, to further illustrate restriction of a tilting angle by the rectangular opening 62*b* and tab 34*b* along the second axis.

Figure 8:
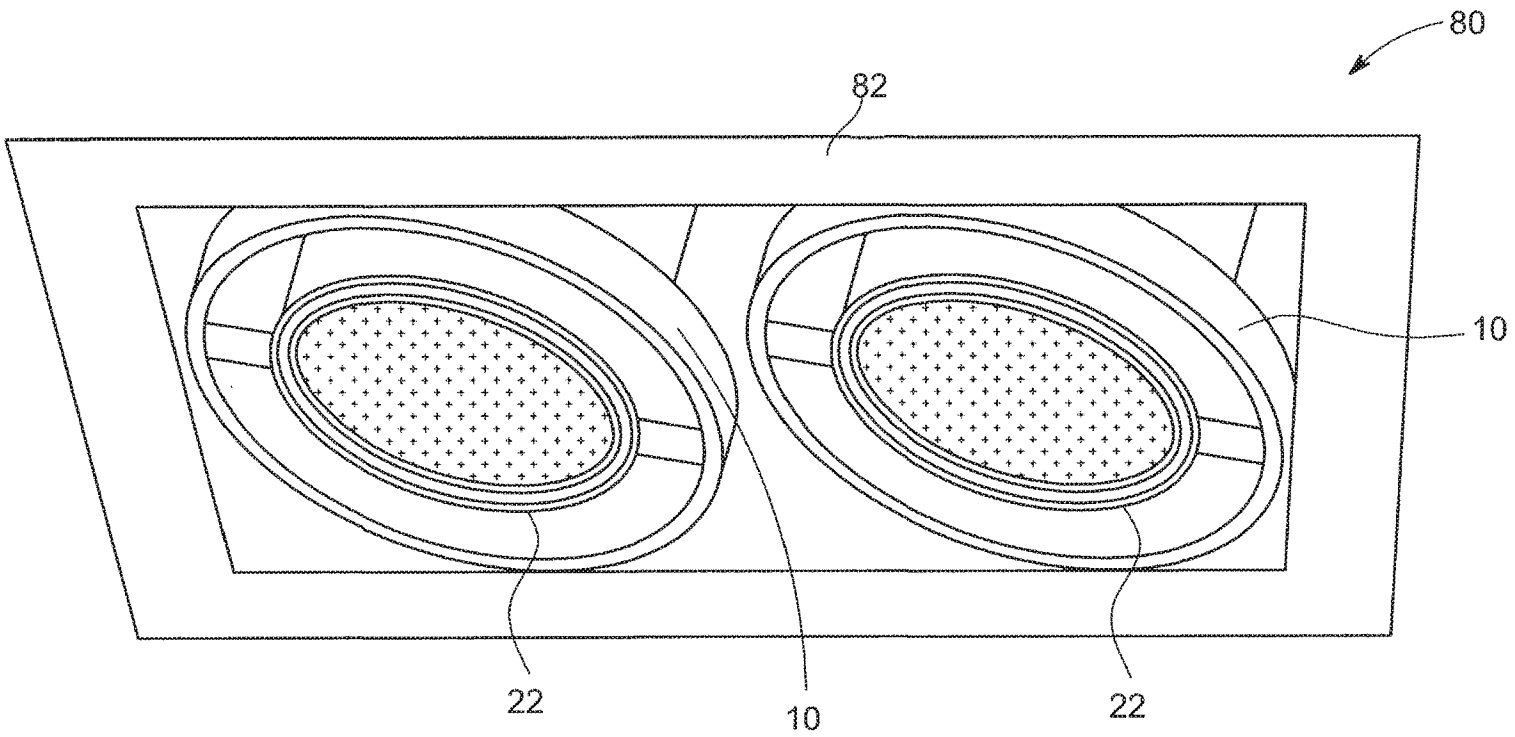
FIG. 8 is a perspective view of an adjustable luminaire that includes two integrated ring assemblies in accordance with some embodiments of the invention.

FIG. 8 is a perspective view of a luminaire assembly 80 that includes a luminaire housing 82 and two light sources, wherein each light source includes integrated ring assemblies having a light source housing 22 and ring component 10 configured for limiting the rotational and/or adjustment capabilities of the luminaires along a first axis and a second axis, in accordance with various embodiments.

In some implementations, the use of common connectors, such as screws and/or nuts (e.g., locknuts), along with ring component features that perform spacer functions, which enable the luminaire head to be aimed or guided by a user in a desired direction and then held or retained in that position without any additional spacers, decreases the costs involved in manufacturing and then assembling the adjustable luminaires. In addition, embodiments described herein do not require any additional parts or components in order to achieve rotational limitation of the luminaire head, which houses the light source(s). Instead, integrated features, such as the tabs of the integrated cardan ring component in combination with one or more openings in the luminaire housing, serve to restrict or limit the rotational range of the luminaire head. Such solutions, involving portions of the luminaire housing (and/or a frame, wall or the like), and integrated portions of the ring component, make the disclosed adjustable cardan mechanism design less expensive and simpler to manufacture and assemble as compared to conventional adjustable light fixture gimbal system assemblies. Accordingly, the simplified design facilitates manufacturing and assembly of adjustable luminaires resulting in decreased costs. In addition, some implementations do not require threaded holes which further simplifies manufacture and/or assembly. Thus, a luminaire head (or light source housing) as disclosed herein can be adjustably attached and/or affixed to the ring component along a first rotation axis, and then the integrated ring assembly (which includes the ring component and the luminaire head) can be adjustably attached and/or affixed to a luminaire housing or to walls of a lighting fixture along a second axis of rotation in such manner that there is no interference between the luminaire head and the housing. In addition, in embodiments that include two or more luminaires, there is no interference between luminaire heads.

Unless defined otherwise, technical and scientific terms used herein have the same meaning as is commonly understood by one having ordinary skill in the art to which this disclosure belongs. The terms "first", "second", and the like, as used herein, do not denote any order, quantity, or importance, but rather are employed to distinguish one element from another. Also, the terms "a" and "an" do not denote a limitation of quantity, but rather denote the presence of at least one of the referenced items. The use of "including," "comprising" or "having" and variations thereof herein are meant to encompass the items listed thereafter and equivalents thereof, as well as additional items. The terms "connected" and "coupled" are not restricted to physical or mechanical connections or couplings, and can include electrical and optical connections or couplings, whether direct or indirect.

Furthermore, the skilled artisan will recognize the interchangeability of various features from different embodiments. The various features described, as well as other known equivalents for each feature, can be mixed and matched by one of ordinary skill in this art, to construct additional systems and techniques in accordance with principles of this disclosure.

In describing alternate embodiments of the apparatus described herein, specific terminology may have been employed for the sake of clarity. The invention, however, is not intended to be limited to the specific terminology so selected. Thus, it is to be understood that each specific element includes all technical equivalents that operate in a similar manner to accomplish similar functions.

It is to be understood that the foregoing description is intended to illustrate and not to limit the scope of the invention, which is defined by the scope of the appended claims. Other embodiments are within the scope of the following claims.

It is noted that various non-limiting embodiments described and claimed herein may be used separately, combined or selectively combined for specific applications.

Further, some of the various features of the above non-limiting embodiments may be used to advantage, without the corresponding use of other described features. The foregoing description should therefore be considered as merely illustrative of the principles, teachings and exemplary embodiments of this invention, and not in limitation thereof.

What is claimed is:

1. An integrated ring assembly for an adjustable luminaire comprising:

a ring component comprising:

a generally circular ring;

a first inward connector of the generally circular ring having a through hole and extending inwardly a predetermined distance from the ring component along a first axis;

a second inward connector of the generally circular ring having a through hole and extending inwardly a predetermined distance from the circular ring component along the first axis opposite the first inward connector;

a first outward connector of the generally circular ring comprising a through hole and a first tab and extending outwardly a predetermined distance from the ring component along a second axis; and a second outward connector of the generally circular ring comprising a second through hole and a second tab and extending outwardly a predetermined distance from the circular ring component along the second axis opposite the first outward connector; and a luminaire head comprising first and second holes positioned for accepting a first fastener inserted through the through hole of the first inward connecter and a second fastener inserted through the through hole of the second inward connector.

2. The integrated ring assembly of claim 1, further comprising a first receptacle in the first outward connector configured for accommodating a fastener component.

3. The integrated ring assembly of claim 1, further comprising a second receptacle in the second outward connector configured for accommodating a fastener component.

4. The integrated ring assembly of claim 1, wherein the first axis is in a plane of and crosses a center point of the ring component.

5. The integrated ring assembly of claim 1, wherein the second axis is in a plane of and crosses a center point of the ring component.

6. The integrated ring assembly of claim 1, wherein the first axis and the second axis are in a plane of and cross a center point of the ring component.

7. The integrated ring assembly of claim 1, wherein the first axis and the second axis are perpendicular to each other.

8. A rotatable luminaire comprising:

a luminaire housing;

a cardan mechanism rotatably connected to the luminaire housing; and a light source housing rotatably connected to the cardan mechanism;

wherein the cardan mechanism comprises:

a generally circular ring having a first inward connector having a through hole and extending inwardly a predetermined distance from the generally circular ring along a first axis;

a second inward connector of the generally circular ring having a through hole and extending inwardly a predetermined distance from the generally circular ring along the first axis opposite the first inward connector;

a first outward connector of the generally circular ring comprising a through hole and a first tab and extending outwardly a predetermined distance from the generally circular ring along a second axis; and a second outward connector of the generally circular ring comprising a second through hole and a tab and extending outwardly a predetermined distance from the generally circular ring along the second axis opposite the first outward connector; and wherein the light source housing comprises:

first and second holes positioned for accepting a first fastener inserted through the through hole of the first inward connecter of the generally circular ring and a second fastener inserted through the through hole of the second inward connector of the generally circular ring.

9. The rotatable luminaire of claim 8, wherein the first inward connector and the second inward connector are configured for holding the light source housing without any additional spacers inside of the generally circular ring such that a light source within the light source housing can be rotated about the first axis.

10. The rotatable luminaire of claim 8, further comprising a first receptacle in the first outward connector configured for accommodating a first fastener component.

11. The rotatable luminaire of claim 10, wherein the first fastener component is a locknut configured to snugly fit into the first receptacle.

12. The rotatable luminaire of claim 8, further comprising a second receptacle in the second outward connector configured for accommodating a second fastener component.

13. The rotatable luminaire of claim 12, wherein the second fastener component is a locknut configured to snugly fit into the second receptacle.

14. The rotatable luminaire of claim 8, wherein the first axis is in a plane of and crosses a center point of the ring component.

15. The rotatable luminaire of claim 8, wherein the second axis is in a plane of and crosses a center point of the ring component.

16. The rotatable luminaire of claim 8, wherein the first axis and the second axis are in a plane of and cross a center point of the ring component.

17. The rotatable luminaire of claim 8, wherein the first axis and the second axis are perpendicular to each other.

18. The rotatable luminaire of claim 8, wherein the first tab and the second tab are configured for movement within openings having predefined dimensions in walls of the luminaire housing, such that the predefined dimensions of the openings define the rotation range of the light source housing when rotated about the second axis.

19. The rotatable luminaire of claim 8, wherein the first and second fasteners comprise screws.

20. The rotatable luminaire of claim 8, wherein the first and second fasteners have end portions that are smooth round surfaces.

* * * * *